United States Patent [19]

Hugelin

[11] 3,969,071

[45] July 13, 1976

[54] CARRIERS AND THEIR USE IN PRINTING AND DYEING

[75] Inventor: Bernard Hugelin, Gaillard, France

[73] Assignee: Sublistatic Holding S.A., Glaris, Switzerland

[22] Filed: Sept. 4, 1974

[21] Appl. No.: 503,163

[30] Foreign Application Priority Data

Sept. 13, 1973 Switzerland ..... 13176/73

[52] U.S. Cl. ..... 8/2.5 R; 8/62; 8/163; 8/176; 8/177 AB

[51] Int. Cl.[2] ..... D06P 3/70

[58] Field of Search ..... 8/2.5

[56] References Cited

UNITED STATES PATENTS

| | | | |
|---|---|---|---|
| 1,993,524 | 3/1935 | Pöschel | 41/33 |
| 2,067,435 | 1/1937 | Chatfield et al. | 41/33 |
| 2,755,200 | 7/1956 | Balon | 117/36 |
| 2,911,280 | 11/1959 | Cicogna | 8/2.5 |
| 3,347,865 | 10/1967 | Brack et al. | 260/313.1 |

FOREIGN PATENTS OR APPLICATIONS

| | | |
|---|---|---|
| 536,192 | 6/1973 | Switzerland |
| 1,221,126 | 2/1971 | United Kingdom |

OTHER PUBLICATIONS

Moore, J. Soc. Dyers and Colourists, 1974 (Sept.), pp. 318–325.

*Primary Examiner*—Joseph L. Schofer
*Assistant Examiner*—A. L. Clingman
*Attorney, Agent, or Firm*—Wenderoth, Lind & Ponack

[57] ABSTRACT

Temporary carriers, characterized in that they carry, on at least one of the faces of a heat-resistant sheet, a thin layer formed from a binder containing at least one cationic dyestuff, and a second layer, which is formed from a binder which can be of the same nature as that of the preceding layer, and which contains an agent which can change the anion of the cationic dyestuff and can render it hot-transferable.

12 Claims, No Drawings

CARRIERS AND THEIR USE IN PRINTING AND DYEING

The present invention relates to a process for dry-printing and dry-dyeing materials which show affinity for cationic dyestuffs, in particular acrylic or mod-acrylic fibres, and temporary carriers which can be used in this process.

It is known that it is possible to print textiles or other organic materials by dry-transfer of disperse dyestuffs. It is also possible to use basic dyestuffs, for example carbonates, sulphonates, sulphinates or cyanates of cationic dyestuffs. It will be recalled that, in this process, the cationic dyestuffs are converted beforehand to salts which can be hot-transferred or, by neutralisation, to their free base. For this conversion, it is advisable to start from dyestuffs in their commercial form, that is to say in the form of inorganic salts or double salts, and to treat them with suitable reagents such as alkali metal or alkaline earth metal alcoholates, oxides or hydroxides, alkali metal or alkaline earth metal salts of weak acids, ion exchangers, oxidising agents and the like. This modification is carried out between 20° and 60°C in water or in a solvent which is optionally free from water.

The cationic dyestuffs modified in this way are then deposited on a temporary carrier; after drying, the coloured face of the carrier is brought into contact with the surface to be treated and the whole is heated to between 120° and 210°C for 5 to 60 seconds, and then, after transfer of the dyestuff or dyestuffs, the carrier is detached from the surface thus treated.

According to the present invention, the cationic dyestuff can be deposited on the carrier without being converted beforehand to a transferable salt or base. It suffices to apply to the carrier, in the form of a top coat or undercoat, a suitable agent which can change the anion of the dyestuff or dyestuffs and can convert them to hot-transferable products (for example, to salts or to the free base). This makes it possible to deposit cationic and disperse dyestuffs at the same time, which constitutes the best possible compromise between the good light-fastness of disperse dyestuffs and the brilliance and the resistance to resublimation and to wet treatments of cationic dyestuffs. Furthermore, since the light-fastness of the unmodified cationic dyestuffs on the temporary carrier is generally better than that of the modified dyestuffs, it is advantageous to effect the conversion only at the time of transfer. This procedure thus prevents dyestuff salts from recrystallising on the apparatus while the carriers are being printed. Finally, the dyestuff inks show better stability on storage.

The present invention thus relates to an original dyeing or printing process involving dry-transfer of cationic dyestuffs, in which the chemical reaction which makes it possible to transfer these dyestuffs takes place under dry conditions and, in practice, at the same time as the transfer. This process is carried out by applying the surface to be dyed or printed to that face of a heat-resistant temporary carrier which carries a thin layer formed from a binder containing at least one cationic dyestuff, and a second layer, which is formed from a binder which can be of the same nature as that of the preceding layer, and which contains an agent which can change the anion of the cationic dyestuff and can render it hot-transferable; thereafter, the whole is heated at 160° – 200°C for the period of time necessary to enable the cationic dyestuff or dyestuffs to undergo modification to form a hot-transferable product, to pass from the carrier to the material to be dyed or printed, and to penetrate into the latter.

It is surprising that the modification of the dyestuffs can take place at the time of heating, that is to say under dry conditions, and can do so even although the two constituents of the reaction are present in different layers. (It will be recalled that, in the unmodified form, the majority of cationic dyestuffs are difficult to transfer, that is to say they do not pass readily into the vapour state and generally do not undergo transfer, at least not in sufficient amount to enable them to be used in a dry heat-printing process.)

The temporary carriers which are a further subject of the present invention possess, on at least one of the faces of a sheet, a strip or tape of a heat-resistant material (that is to say a material which is resistant to temperatures of the order of at least 220°C), a thin layer formed from a binder containing at least one cationic dyestuff, and a second layer (permeable to dyestuff vapours if a top coat is involved) formed from a binder containing an agent which can change the anion of the cationic dyestuff and in particular can convert it to the free base or to transferable salts; such agents are, for example, alkali metal or alkaline earth metal oxides, hydroxides or alcoholates, or alkali metal and alkaline earth metal salts of carboxylic acids or of hydrocyanic acid or of boric acid. Their combination with the dyestuff enables the latter to vaporise or sublime below 210°C to the extent of at least 60%, over the course of less than 100 seconds. The two layers are arranged in any order whatsoever.

It is nevertheless advantageous to use the lacquer containing the alkalising agent to form the undercoat. This makes it possible in particular, when forming the top layer, to avoid soiling the printed pattern, since the solvents for the alkalising agents also often act as slight solvents for the cationic dyestuffs. Moreover, the use of the undercoat enables possible acidity of the paper to be neutralised.

The base for the temporary carriers must not retain the dyestuffs and must be resistant to temperatures of the order of 210°C. Sheets of metal (for example, sheet steel or aluminum foil), certain synthetic films and, preferably, paper such as newsprint (which it is advantageous to coat with a film which does not retain the dyestuffs but prevents the ink from penetrating into the paper) or, still better, uncoated glazed paper of the parchment or sulphurised paper type will be used for this purpose.

These carriers are treated with one or more inks containing the modified or unmodified cationic dyestuff or dyestuffs. The constituents of these coloured inks are the same as in the known processes, namely water or a volatile solvent or a mixture of the two, a binder which is stable below 210°C, a cationic dyestuff and, optionally, a vaporisable dyestuff from a different category.

In order to facilitate their application or to increase the quantity of dyestuffs transferred, the inks can contain various additives such as, for example, plasticisers, wetting agents or products which inhibit recrystallisation phenomena. Amongst these additives, polyvinylpyrrolidone, decalin, tetralin and the condensation product of octylphenyl with ethylene oxide may be mentioned.

The cationic dyestuffs which can be used according to the invention are dyestuffs known by the name of basic dyestuffs; they contain a carbonium, ammonium, oxonium or sulphonium group, Their molecular weight preferably does not exceed 400.

They can be mono- or poly-methine, azomethine, diphenyl- or triaryl-methane, xanthene, acridine, anthraquinone, oxazine, thiazine, thiazole, quinoline, indamine or monoazo basic compounds.

They can be used in the invention in the form which has already undergone modification or in their commercial form, preferably undiluted.

Other sublimable dyestuffs, such as some disperse dyestuffs, can be used in conjunction with the cationic dyestuffs, inter alia those which are mentioned in Swiss Patent 536,192; it suffices that they pass into the vapour state at temperatures below 210°C to the extent of at least 60%, preferably within 60 seconds. It is also possible to add to the inks containing the cationic dyestuff, dyestuffs which are intended to render the inks visible while the temporary carrier is being printed. In fact, cationic dyestuffs modified so as to render them transferable can be colourless. In order to make the prints on the paper visible, it is possible to use, in conjunction with the cationic dyestuffs, dyestuffs of another type which may or may not be vaporisable, for example pigments, acid dyestuffs or disperse dyestuffs.

Stable binders, that is to say binders which do not decompose at the temperature at which the modification and the transfer take place, are optionally present in the coloured inks. They are commercially available and are widely used for the direct printing of textile materials; however, it is advisable to choose them from amongst those which have a low solids content. It must be possible to dry them to give a film which holds the dyestuff or dyestuffs used on the paper, without modifying them. Binders which are soluble in the liquid media of the ink and which dry rapidly by eliminating the solvent are preferably used. The following compounds may be mentioned by way of example: Alginates, polyvinyl alcohol, carob gums, tragacanth gum, dextrins, hydroxyethyl- and carboxymethyl-celluloses as well as cellulosic esters and ethers such as cellulose acetylbutyrate and cellulose acetate or methyl-, ethyl-, propyl-, isopropyl-, benzyl-, hydroxypropyl- and cyanoethylcellulose, as well as their mixtures.

As in the known processes, water or organic solvents (optionally diluted with water), the boiling point of which at atmospheric pressure is below 120°C and preferably below 105°C, are used as the liquid medium for the inks intended to form the coloured layer. As examples of such solvents, there may be mentioned hydrocarbons (which may or may not be halogenated) of the aliphatic or aromatic series such as toluene, cyclohexane and n-hexane, petroleum ether, alcohols of low molecular weight such as methanol, ethanol, isopropyl alcohol and n-propyl alcohol, esters of an aliphatic acid such as ethyl acetate, ketones such as methyl ethyl ketone, and the like.

The inks containing the dyestuffs can be applied to the carrier with a brush or a gun, or by spraying, coating, impregnating or printing (photogravure, flexography, serigraphy, printing using a frame which may or may not rotate, lithography, offset and the like). The intermediate drying process between the deposition of the layer containing the dyestuff or dyestuff and the formation of the top layer can be effected by means of a stream of hot air or by exposure to infra-red radiation. The volatile solvents can be recovered. It is also possible to treat both faces of the carrier.

The agent which can change the anion of the cationic dyestuff is applied in the form of an undercoat or a top coat, starting from a liquid preparation consisting of water or a solvent (optionally diluted with water), which contains a binder and the alkalising agent intended to modify the cationic dyestuff. The latter can be either dissolved or dispersed. The binder and the solvent can be chosent to be different from or identical to those already mentioned for the layer containing the dyestuff.

However, the binder chosen must be stable to electrolytes. This layer can also contain vaporisable or non-vaporisable dyestuffs other than the unmodified cationic dyestuffs.

As modifying electrolytes or alkalising agents which can be used, there may be mentioned, for example, alkali metal or alkaline earth metal hydroxides or alcoholates, sodium, potassium or lithium carbonates and bicarbonates, alkali metal and alkaline earth metal salts of carboxylic acids (for example, sodium and potassium acetates, sodium formate and sodium lactate, and potassium stearate), sodium, potassium and lithium sulphinates, cyanides, cyanates, isocyanates, thiocyanates, phosphates and borates, and alkaline earth metal salts of weak acids or diacids as well as alcholates (such as sodium methylate). It is also possible to use products which become basic on heating, such as salts of an acid which undergo decarboxylation (sodium oxalate or sodium tartrate), or alkali metal or alkaline earth metal oxides which, in the presence of water, change into the corresponding hydroxides.

If the alkalising agent is applied in the form of a top coat, the latter must not be too thick so that it does not become impermeable to the vapours of the modified cationic dyestuffs and of the other vaporisable dyestuffs optionally present. However, the concentration of the modifying agent and the viscosity of the top coat ink must be adjusted so that there is a sufficient amount of modifying agent to react with all the cationic dyestuff present.

These inks (or lacquers) containing the modifying agent can be applied directly to the base of the carrier (undercoat) or after the latter has been treated with the inks containing the cationic dyestuffs (top coat). It will be recalled that in the case where a carrier base, such as a porous paper like newsprint, is used, it is advisable to coat this base with a film which prevents the products to be transferred from penetrating into this base, since this would exert a detrimental effect on the satisfactory exhaustion of the dyestuffs. The modifiying agent can then be applied with this film, which avoids an additional operation.

The inks can be applied in accordance with techniques which are in themselves known, for example by offset, photogravure or flexography, printing with a rotating frame and the like.

The dyeing or printing which is a further subject of the present invention consists of bringing the temporary carrier, prepared in the manner which has just been described, into contact (at least locally) with the material to be dyed or printed which, during this period of contact, is preferably heated to a temperature of the same order of magnitude as that at which the modified dyestuffs pass into the vapour state, in order to prevent the latter from simply condensing on the surface. The dyeing or printing is thus reduced to a pass over a hot plate or a hot calender or over any other apparatus which makes it possible to bring the temporary carrier and the material to be treated into contact and to heat them to the required temperature for the necessary period of time; thus it is possible to use rotating drums or heated chambers; these apparatuses can possess a device which makes it possible to establish a partial vacuum or, on the contrary, an excess pressure; the source of heat can be oil which is circulated, infra-red radiation or microwaves, electrical resistances and the like; the substrate can be preheated. No subsequent washing or vaporising treatment is necessary to ensure that the dyestuff is fixed or to prevent it from being discharged subsequently.

The present process is suitable for dyeing natural materials such as mordanted cotton, leather, silk and wool, or synthetic materials such as polyacrylonitriles, modacrylic materials, copolymers of acrylonitrile and vinylidene chloride, copolymers of vinylidene cyanide and vinyl acetate or vinyl alcohol, methyl methacrylate and the like. It is also suitable for dyeing and printing acid-modified synthetic materials such as polyamides, for example the polycondensation products obtained from 4,4'-diamino-2,2'-diphenyl disulphonic acid or 4,4'-diamino-2,2'-diphenyl-alkane disulphonic acids or such as the polycondensed products obtained from monocarboxylic acids or their derivatives which form amides or from dicarboxylic acids and diamines with dicarboxylic aromatic sulphonic acids (for example, by polycondensation of ε-caprolactam or hexamethylenediamine adipates with potassium 3,5-dicarboxybenzene-sulphonates), or acid-modified polyesters, such as the condensed products or aromatic polycarboxylic acids (for example, terephthalic or isophthalic acids), polyalcohols (for example ethylene glycol) or sodium 3-(1,3- or 1,2-dihydroxypropoxy)-propane-sulphonate or 3-(2,3-dimethylolbutoxy)-propane-sulphonate or 3,5-dicarboxybenzene-sulphonic acid or sulphonated terephthalic acids, or 4-methoxybenzene-sulphonic acid or diphenyl-4,4'-dicarboxylic diacids.

The materials to be dyed can be in the most diverse forms, for example in the form of sheets, films, coverings, felts, staple fibre, carpets, yarns, knitted fabrics, woven webs of various thicknesses or non-woven fabrics in the pure state or mixed, for example, with cotton or wool.

In the following non-limiting examples, the parts and percentagees given are expressed by weight, unless otherwise indicated, and the temperatures are in degrees centigrade.

EXAMPLE 1

5% of Fast Green JJO (Basic Green 1-C.I. 42040) (Ciba-Ceigy) are added, with vigorous stirring, to a solution containing 9% of ethyl-cellulose E7 (Ethocel, Dow Chemicals), in ethyl alcohol denatured by 2% of methyl ethyl ketone. The ink thus obtained is spread on a paper of the photogravure type to the extent of 12g per $m^2$. After drying, a top coat is formed using a lacquer containing 50 g of calcined sodium carbonate per liter of a solution containing 4% of polyvinyl alcohol (RHODOVIOL 4/125, RHONE POULENC) in a mixture of ethyl alcohol and water (50-50).

After drying, the paper thus produced is placed in contact with a fabric woven from ORLON 42, in a press heated to 190°C, for 35 seconds. This results in the woven fabric being printed well, in a brilliant green which is resistant to resublimation.

An equally satisfactory print is obtained by replacing the 50 g of sodium carbonate by 19 g of sodium hydroxide or 26.4 g of CaO.

EXAMPLE 2

Inks are prepared in the same way as in Example 1, using:

For the red ink: 28 g/l of MAXILON YELLOW 5GL (Basic Yellow 13) (Ciba-Geigy) and 32 g/l of TERASIL BRILLIANT PINK 4BN (Disperse Red 11-C.I. 62015) (Ciba-Geigy), for the blue ink: 44 g/l of MAXILON BLUE 5G (Basic Blue 3-C.I. 51004) (Ciba-Geigy) and 21 g/l of TERASIL BRILLIANT PINK 4BN (Ciba-Geigy), and for the green ink: 33 g/l of MAXILON BLUE 5G (Ciba-Geigy) and 29 g/l of MAXILON YELLOW 5GL (Ciba-Geigy).

A multi-coloured pattern is printed by photogravure on a paper of the "parchment" type.

After drying, the entire surface of a carrier is coated with a lacquer containing 50 g of sodium acetate per liter of a solution containing 8% of ethyl-cellulose E7 in 85% strength ethyl alcohol, and the whole is dried.

The temporary carrier thus obtained makes it possible to transfer the printed pattern onto an acrylin woven fabric in the following way:

A woven fabric made of polyacrylonitrile (Acrilan 16) is placed on the printed face of the paper and the whole is passed over a metal plate heated electrically to 190°C. A second non-heated plate ensures even contact. The duration of hot contact is 40 seconds. A faithful reproduction of the design, the lines of which remain sharp, is thus obtained on the woven fabric. The colours are brilliant and possess excellent fastness to washing.

An equally satisfactory print is obtained by replacing the 50 g of sodium acetate by 32 g of potassium hydroxide or 24.3 g of sodium hydroxide.

EXAMPLE 3

Inks are prepared by using the following dyestuffs:

For the light green ink: 41 g/l of FAST GREEN JJO (Ciba-Geigy) and 39 g/l of TERASIL YELLOW 2GW (Disperse Yellow 54) (Ciba-Geigy), for the golden yellow ink: 32 g/l of ASTRAZON ORANGE G (Basic Orange 21-C.I. 48035) (Bayer) and 48 g/l of TERASIL YELLOW 2GW (Ciba-Geigy)

and for the violet-red ink: 42 g/l of ASTRAZON VIOLET RED (Basic Violet 16-C.I. 48013) (Bayer).

These dyestuffs are then added to a 4% strength solution of polyvinyl alcohol in a mixture of ethyl alcohol and water (50-50).

After printing the paper in accordance with the desired pattern, by means of engraved copper rollers, the printed face is coated with a solution of ethyl alcohol (85%) thickened with 7% of ethyl-cellulose E7 and containing 5% of sodium monohydrogenophosphate, to the extent of 12 g of this solution per square meter, and the whole is dried.

Using the temporary carrier thus obtained, it is possible to print polyacrylonitrile woven fabrics in fresh colours which are fast to washing, by employing the procedure described in the last paragraph of Example 2.

EXAMPLE 4

A paper of the photogravure type is coated to the extent of 24 g per square meter with a solution containing 7% of ethyl-cellulose E7 (Dow Chemicals) in ethyl alcohol containing 50 g/l of sodium methylate.

After drying, the paper is coated in the same way as in Example 1, using a solution containing 50 g/l of Fast Green JJO in ethyl alcohol, thickened with 7% of ethyl-cellulose E7.

A uniform green carrier is obtained. Transfer is effected as in Example 1, but onto a woven fabric made of acid-modified polyester fibres (DACRON* 64). This results in a good even printing of the woven fabric, the print being resistant to resublimation.

Good results are also obtained by using 45 g/l of sodium hydroxide or 50 g/l of potassium hydroxide instead of sodium methylate.

*Registered Trade Mark of DU PONT De Nemours

EXAMPLE 5

A paper of the parchment type is coated to the extent of 24 g per square meter with a solution of 5% of ethyl-cellulose E22 (Dow Chemicals) in ethyl alcohol containing 10 g/l of lithium hydroxide and 10 g/l of ORASOL Red 2B (Solvent Red 9) (CIBA-GEIGY) in order to be able to see that the layer is uniform.

After drying, printing is effected using the following inks:

Red ink: 80 g of MAXILON Brilliant Red 3B (Basic Red 26) and 20 g of MAXILON Yellow 5GL per liter;

golden yellow ink: 30 g of ASTRAZON Gold Yellow GL (Basic Yellow 28) and 20 g of ASTRAZON Blue FRR (Basic Blue 69) per liter;

and

Green ink: 30 g of MAXILON Yellow 5GL and 20 g of ASTRAZON Blue FRR per liter.

These dyestuffs are then added to an alcoholic solution containing 5% of Ethocel N22 (Hercules) containing 10% of benzoic acid.

The pattern printed with these inks, by means of engraved copper rollers, thus retains colours close to those obtained by transfer, in accordance with the last paragraph of Example 2, onto a polyacrylonitrile woven fabric.

EXAMPLE 6

5 parts of calcium oxide are dispersed, in a glass bead mill, in 50 parts of absolute ethyl alcohol until a grain size of less than 5 microns is obtained. The dispersion is isolated from the glass beads, and 30 parts of a 20% strength solution of ethyl-cellulose in absolute alcohol are added.

The whole is homogenised by means of a paint stirrer.

This lacquer is spread evenly on a paper of the photogravure type to the extent of 12 g/m².

After drying, the paper thus obtained coated, to the extent of 15 g/m², with the ink, the preparation of which is described in the 1st paragraph of Example 1.

A lacquer containing 10% by weight of polystyrene is xylene is deposited, to the extent of 12 g/m², on the paper thus printed.

This top coat makes it possible, in particular, to give the paper excellent resistance to wet handling.

Transfer is effected onto a polyacrylonitrile woven fabric of the ORLON 42 type (Du Pont) as already described. The print is in a vivid green shade which is fast to washing.

I claim:

1. In a temporary carrier for use in the dry transfer printing or dyeing process said temporary carrier comprising an inert, heat-resistant base sheet bearing on at least one face thereof a transfer coating the improvement according to which the transfer coating comprises (a) a layer comprising (1) at least one cationic dyestuff which after reacting with an alkalizing agent passes into the vapor state at a temperature of from 160°C to 210°C and (2) a binder which upon drying forms a film sufficient to bond the dyestuff to the carrier base, which film is inert to the dyestuff and does not decompose under conditions of transfer, and (b) a layer comprising (1) an alkalizing agent which is capable of reacting with cationic dyestuff present in layer (a) to render said dyestuff vaporizable at a temperature of from 160°C to 210°C said agent being selected from the group consisting of an alkali or alkaline earth metal hydroxide, an alkali or alkaline earth metal alcoholate and an alkali or alkaline earth metal salt of a weak acid and (2) a binder which is stable to electrolytes, which upon drying forms a film which is inert to dyestuff present during transfer and which does not decompose under conditions of transfer.

2. A temporary carrier according to claim 1 wherein the alkalizing agent is selected from the group consisting of (1) a sodium, potassium or lithium hydroxide, (2) a sodium, potassium or lithium alcoholate, (3) a sodium, potassium or lithium carbonate, (4) a sodium, potassium or lithium bicarbonate, (5) a sodium, potassium or lithium carboxylate, (6) a sodium, potassium or lithium borate, (7) a sodium, potassium or lithium phosphate and (8) a sodium, potassium or lithium sulfinate.

3. A temporary carrier according to claim 1 wherein cationic dyestuff present has a molecular weight not in excess of 400.

4. A temporary carrier according to claim 1 wherein the layer (a) also contains at least one transferable disperse dyestuff.

5. A temporary carrier according to claim 1 wherein layer (a) overlies layer (b).

6. A temporary carrier according to claim 1 wherein the binder of layer (b) is a water-soluble binder.

7. A temporary carrier according to claim 1 wherein the binder of layer (b) is soluble in an organic solvent from the group of alcohols and ketones of low molecular weight.

8. A temporary carrier according to claim 1 wherein the binder of layer (a) is water-insoluble.

9. A temporary carrier according to claim 1 wherein the base sheet is parchment or sulfurized paper.

10. A temporary carrier according to claim 1 wherein the binder of layers (a) and (b) is ethyl cellulose.

11. A temporary carrier according to claim 1 wherein the binder of layer (a) is ethyl cellulose and the binder of layer (b) is polyvinyl alcohol.

12. In a method for the dry transfer printing or dyeing or organic material which comprises bringing into contact the surface of the organic material to be dyed or printeed and the transfer coated surface of a temporary carrier, subjecting the temporary carrier and organic material to heating at a temperature of about 160° to about 220° for a time sufficient to effect transfer and separating the organic material and temporary carrier, the improvement according to which the organic material is a material which can be dyed or printed with cationic dyestuff, the temporary carrier is as defined in claim 1, and the time of heating to effect transfer is sufficient to permit reaction between the alkalizing agent and cationic dyestuff and for the thus formed vaporizable dyestuff to pass from the temporary carrier to the organic material and to penetrate into the said organic material.

* * * * *

Notice of Adverse Decision in Interference

In Interference No. 100,618, involving Patent No. 3,969,071, B. Hugelin, NEW CARRIERS AND THEIR USE IN PRINTING AND DYEING, final judgment adverse to the patentee was rendered Mar. 24, 1982, as to claims 1–3, 5, 9–12.

[*Official Gazette June 8, 1982.*]